United States Patent [19]

Nishizaki et al.

[11] 4,409,799

[45] Oct. 18, 1983

[54] HEAT PUMP DEVICE

[75] Inventors: Tomoyoshi Nishizaki, Suita; Minoru Miyamoto, Kusatsu; Kazuaki Miyamoto, Amagasaki; Ken Yoshida, Ibaraki; Katuhiko Yamaji; Yasushi Nakata, both of Osaka, all of Japan

[73] Assignee: Sekisui Kagaku Kogyo Kabushiki Kaisha, Osaka, Japan

[21] Appl. No.: 320,741

[22] Filed: Nov. 12, 1981

[30] Foreign Application Priority Data

| | | | |
|---|---|---|---|
| Nov. 13, 1980 | [JP] | Japan | 55-160527 |
| Nov. 13, 1980 | [JP] | Japan | 55-160528 |
| Dec. 29, 1980 | [JP] | Japan | 55-185355 |

[51] Int. Cl.[3] ..... F25B 00/00

[52] U.S. Cl. ..... 62/467 R

[58] Field of Search ..... 62/119, 467, 514, 268–270, 62/324.1, 324.2, 324.5, 159

[56] References Cited

U.S. PATENT DOCUMENTS

| | | | |
|---|---|---|---|
| 3,621,665 | 11/1971 | Mokadam | 62/467 X |
| 3,621,666 | 11/1971 | Mokadam | 62/467 X |
| 3,848,424 | 11/1974 | Rhea | 62/467 X |

*Primary Examiner*—Lloyd L. King

*Attorney, Agent, or Firm*—Wenderoth, Lind & Ponack

[57] ABSTRACT

A heat pump device comprising a closed receptacle divided into a first chamber and a second chamber, means forming a hydrogen flow passage extending through the two chambers, said hydrogen flow passage permitting the flow of hydrogen but rejecting the flow of metal hydrides between the two chambers and being made at least partly of a porous material permeable to hydrogen and elastically deformable in response to an applied pressure, a first metal hydride filled in the first chamber and a second metal hydride filled in the second chamber.

8 Claims, 13 Drawing Figures

HEAT PUMP DEVICE

This invention relates to a heat pump device including metal hydrides.

It is known that a certain metal or alloy exothermically occludes hydrogen to form a metal hydride, and the metal hydride endothermically releases hydrogen in a reversible manner. Many such metal hydrides have been known, and examples include lanthanum nickel hydride ($LaNi_5H_{xL}$), *calcium nickel hydride* ($CaNi_5H_x$), misch metal nickel hydride ($M_mNi_5H_x$), iron titanium hydride ($FeTiH_x$), and magnesium nickel hydride ($Mg_2NiH_x$). In recent years, heat pump devices built by utilizing the characteristics of the metal hydrides have been suggested (for example, see Japanese Laid-Open Patent Publication No. 22151/1976).

In many of such conventional heat pump devices, the occlusion and releasing of hydrogen are performed by filling metal hydrides in closed receptacles serving as heat exchangers. Since a metal hydride generally expands in volume when occluding hydrogen, conventional closed receptacles of this type are designed so as to avoid deformation or damage which may be caused by mechanical stresses attributed to the volume expansion of metal hydrides as well as by the equilibrium dissociation pressure of the metal hydrides under the operating conditions. As a result, the receptacles have an increased weight per unit amount of the metal hydride, i.e. an increased heat capacity, and require a greater heat energy for driving, and have a decreased output. This reduces the coefficient of performance of the apparatus.

Furthermore, metal hydrides generally tend to be converted to a fine powder during the repetition of occlusion and releasing of hydrogen, thereby making the flow of hydrogen difficult.

It is an object of this invention to provide a heat pump device having an increased coefficient of performance by using relatively high-weight closed receptacles of low heat capacity which require substantially no consideration to the volume expansion of metal hydrides attributed to the occlusion of hydrogen, and therefore need be resistant substantially only to the equilibrium dissociation pressures of the metal hydrides under operating conditions, and which have a hydrogen flow passage that makes possible smooth and rapid occlusion and releasing of hydrogen.

The heat pump device of the invention comprises a closed receptacle divided into a first chamber and a second chamber, means forming a hydrogen flow passage extending through the two chambers, said flow passage permitting the flow of hydrogen, but rejecting the flow of metal hydrides, between the two chambers and being made at least partly of a porous material permeable to hydrogen and elastically deformable in response to an applied pressure, a first metal hydride filled in the first chamber and a second metal hydride filled in the second chamber.

The heat pump device of the invention includes a porous material which is elastically deformable in response to an applied pressure. Accordingly, when the metal hydrides filled in the closed receptacle expand upon occlusion of hydrogen, the porous material shrinks in response to the expansion of the metal hydrides and absorbs the mechanical stress generated by the expansion of the metal hydrides. Consequently, no stress is exerted on the receptacle, or the stress on the receptacle is decreased, and therefore, the tendency of the receptacle to undergo deformation or damage is reduced. For this reason, the wall of the receptacle can be made relatively thin, and its heat capacity can be decreased. Furthermore, since the device of this invention includes a hydrogen passage extending between the two chambers of the closed receptacle, the flow of hydrogen within each of the chambers and between the two chambers is effected smoothly even when the metal hydrides are converted to a fine powder during hydrogen occlusion and releasing. Consequently, the coefficient of performance of the heat pump device of the invention increases.

It is noted in this regard that Japanese Laid-Open Patent Publication No. 14210/1977 discloses the provision of a partitioning wall made of a porous sintered metal body in a hydrogen storing pressure receptacle containing a metal hydride. However, this Patent Publication fails to disclose a heat pump device, and the porous sintered metal body is not elastically deformable in response to a variation in pressure.

Examples of the porous material which is permeable to hydrogen and elastically deformable in response to an applied pressure include porous plastics or natural rubbers, cork, and a glass fiber mat. Of these, a porous sintered body or stretched porous body of polytetrafluoroethylene is preferred. There is no particular limitation on the shape of the porous body. It may be a hollow cylinder or prism, or a solid cylinder or prism. Preferably, the porous material is arranged nearly in parallel with the axis of the receptacle. In particular, a hollow cylindrical porous material can be elastically deformed to a great extent in response to an applied pressure.

Desirably, the porous material should be permeable to hydrogen but impermeable to metal hydrides. A typical example of such a porous material is a sintered body or stretched porous body of polytetrafluoroethylene having a pore diameter adjusted to not more than several microns, preferably 1 to 2 microns. It is also possible to use a porous material which is permeable both to hydrogen and metal hydrides. In this embodiment, a shielding material permeable to hydrogen but impermeable to metal hydrides is provided within the passage communicating between the two chambers, and the porous material permeable both to hydrogen and metal hydrides is provided on both sides of the shielding material. The shielding material may be one which is not deformable by pressures. A glass fiber mat is an example of the porous material permeable both to hydrogen and metal hydrides. A sintered metal body is a suitable example of the shielding material.

In one modified embodiment of the device of this invention, a porous material being deformable in response to an applied pressure and permeable to hydrogen but impermeable to metal hydrides is connected to each end of a passage communicating between the two chambers of the receptacle, with the other end extending through each of the two chambers. The manner of connecting the porous materials to the two opposite ends of the passage is not particularly restricted. Preferably, the porous material may be secured to the opening of each end of the passage through a heat-resistant rubber packing, etc. because this ensures smooth flowing of hydrogen from the opening to the porous material.

The closed receptacle used in the device of this invention may be made of stainless steel, copper, aluminum, etc.

The heat pump device of the invention is operated as follows: The first metal hydride in the first chamber is heated to a high temperature $T_H$ to release hydrogen which is then conducted to the hydrogen passage and occluded exothermically by the second metal hydride in the second chamber maintained at an intermediate temperature $T_M$. Then, the first metal hydride is cooled to the intermediate temperature $T_M$ to release hydrogen endothermically from the second metal hydride and to bring the temperature of the second metal hydride to a low temperature $T_L$. The released hydrogen is then exothermically occluded by the first metal hydride. As a result, a cooling output is obtained.

Alternatively, in obtaining a cooling output by releasing hydrogen endothermically from the second metal hydride at $T_L$ and causing it to be occluded by the first metal hydride as in the above-mentioned process, it is possible to maintain the equilibrium dissociation pressure of the second metal hydride lower than that of the first metal hydride until the second metal hydride is cooled to the temperature $T_L$, and to make the equilibrium dissociation pressure of the first metal hydride lower than that of the second metal hydride when the temperature of the second metal hydride has substantially reached the temperature $T_L$, thereby releasing hydrogen endothermically from the second metal hydride. By so doing, the absorption of heat during the reaction of the metal hydride incident to hydrogen transfer can be obtained as an output without waste, and the cooling capacity or the cooling output acquiring capacity of the device is further improved.

On the other hand, for heating purposes, the heat pump device of this invention is operated as follows:

The first metal hydride in the first chamber is heated to the intermediate temperature $T_M$ to release hydrogen which is conducted to the hydrogen passage and caused to be occluded endothermically by the second metal hydride in the second chamber maintained at the low temperature $T_L$. Then, the second metal hydride is heated to the intermediate temperature $T_M$ to release hydrogen from the second metal hydride. This hydrogen is then caused to be exothermically occluded by the first metal hydride, thus bringing the temperature of the first metal hydride to the high temperature $T_H$. As a result, a heating output is obtained.

Alternatively, in obtaining a heating output by releasing hydrogen from the second metal hydride and causing it to be exothermically occluded by the first metal hydride at the high temperature $T_H$, it is possible to maintain the equilibrium dissociation pressure of the first metal hydride higher than that of the second metal hydride until the first metal hydride is heated to the temperature $T_H$, and to make the equilibrium dissociation pressure of the second metal hydride higher than that of the first metal hydride when the first metal hydride has substantialy attained the temperature $T_H$, thereby causing the hydrogen to be exothermically occluded by the first metal hydride. By so doing, the generation of heat during the reaction of the metal hydrides incident to hydrogen transfer can be obtained as an output without waste, and the heating capacity, or the heating output acquiring capacity of the device, is further improved.

Specific embodiments of the heat pump device of this invention will now be illustrated below with reference to the accompanying drawings in which.

Figure 1:
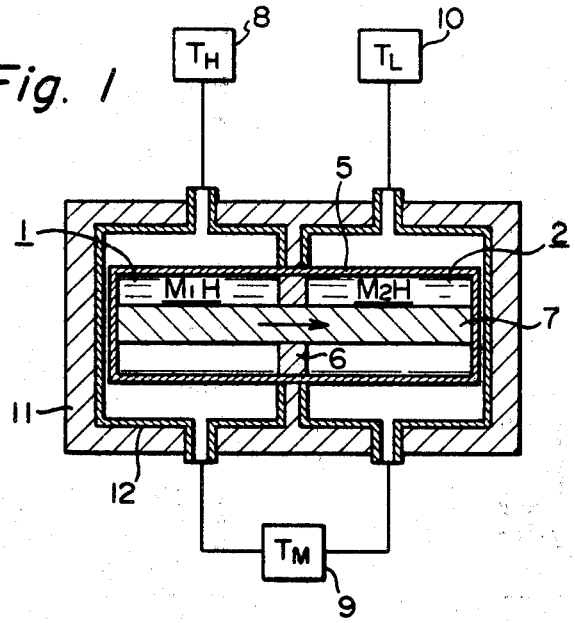
FIG. 1 is a sectional view of one embodiment of the heat pump device of the invention.

Referring to FIG. 1, a closed receptacle 5 is divided into a first chamber 1 and a second chamber 2 by means of a partitioning wall 6, and a rod-like porous material 7 permeable to hydrogen but impermeable to metal hydrides and deformable in response to an applied pressure extends through this partitioning wall between the two chambers. A first metal hydride $M_1H$ is filled in the first chamber, and a second metal hydride $M_2H$, in the second chamber. The equilibrium dissociation pressure characteristics of $M_2H$ exist at a lower temperature than those of $M_1H$. Preferably, a heat-resistant rubber packing or the like (not shown) is interposed between the porous material and the hole through which the porous material extends so that the metal hydrides do not move between the chambers when the metal hydride occludes hydrogen and the porous material shrinks in volume.

Each of the chambers is covered with a jacket 12 having a heat insulating material 11 bonded thereto.

The heat pump device of the invention can be caused to function as a cooling device by thermally connecting $M_1H$ to a high temperature heat source 8 kept at a temperature $T_H$ so that heat exchange can be performed with an intermediate temperature heat medium 9 at an ambient temperature $T_M$ ($<T_H$), and thermally connecting $M_2H$ to a low temperature cooling load 10 at a temperature $T_L$ so that it can be switched over to the intermediate heat medium. The heat medium may be warm water, steam, cold water, atmospheric air, etc.

Figure 2:
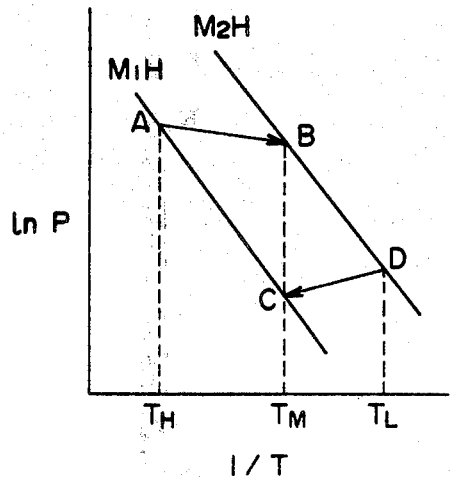
FIG. 2 is a cycle diagram showing the operation of the device of the invention in obtaining a cooling output.

The operation of the device of FIG. 1 is described with reference to the cycle diagram shown in FIG. 2. When $M_1H$ is heated to the temperature $T_H$ by the high temperature heat source 8 and $M_2H$ is maintained at the temperature $T_M$ by the intermediate temperature heat medium 9, $M_1H$ releases hydrogen endothermically (point C to point A). The released hydrogen is then exothermically occluded by $M_2H$ through the porous material 7 (point B). Then, the connection of each of the metal hydrides to the heat medium is switched over. $M_1H$ is cooled to the temperature $T_M$ by the intermediate temperature heat medium 9 and $M_2H$ is connected to the cooling load 10. As a result, $M_2H$ acquires heat from the cooling load and releases hydrogen endothermically to attain the temperature $T_L$ (point B to point D). In the meantime, $M_1H$, while being cooled to the temperature $T_M$ by the intermediate temperature heat medium, exothermically occludes hydrogen supplied from $M_2H$ through the porous material 7 (point C). Thus, using the high temperature heat source as a driving heat source, the cooling load acquires a cooling output at temperature $T_L$.

Figure 3:
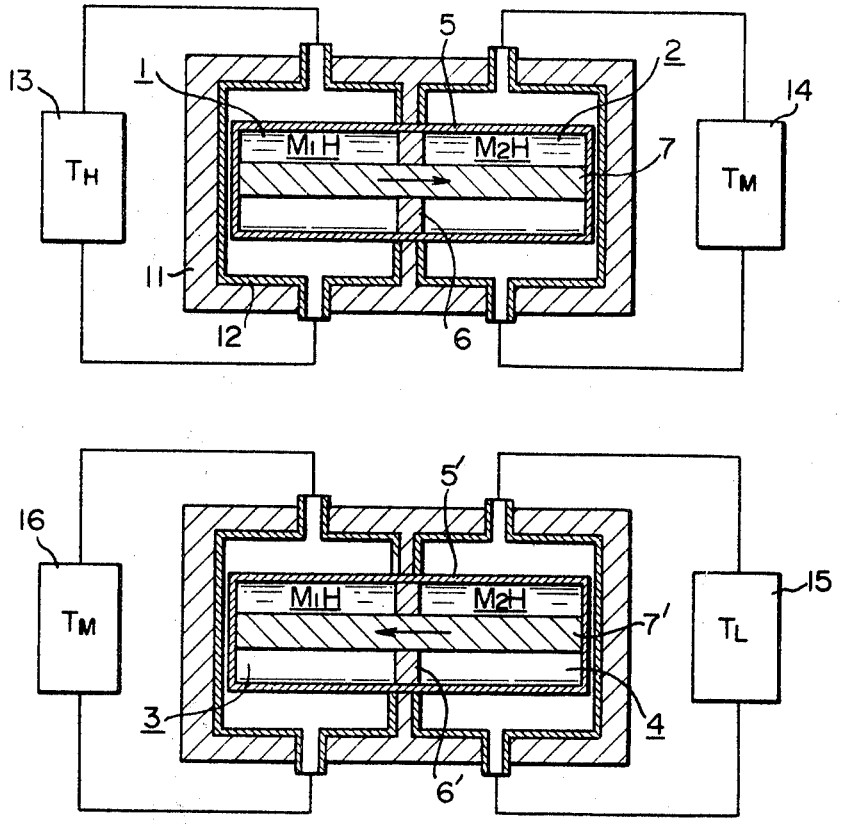
FIG. 3 is a sectional view of another embodiment of the device of the invention, which includes two closed receptacles of the same structure and is adapted to be operated with a phase deviation of a half cycle.

FIG. 3 shows a modified embodiment of the heat pump device of the invention in which two closed receptacles are provided in juxtaposition and are operated with a phase deviation of a half cycle.

The operation of the device of FIG. 3 in obtaining a cooling output is described with reference to FIG. 2. $M_1H$ in a first receptacle 5 [to be referred to as $(M_1H)_1$] is heated by a high temperature heat source 13 to a temperature $T_H$ and releases hydrogen (point A). The released hydrogen is sent to the second chamber 2 via the porous material 7, and while being cooled by a cooler 14 at a temperature $T_M$ (e.g., the temperature of the outer atmospheric air) therein, is exothermically occluded by $M_2H$ in the first receptacle [to be referred to as $(M_2H)_2$] (point B). During this time, $M_2H$ of the second receptacle 5' [$(M_2H)_4$] endothermically releases hydrogen to take away heat from a cooling load 15 at temperature $T_L$ (point D). Hydrogen released in the above process is sent to a third chamber 3 through a porous material 7', and $M_1H$ in a second receptacle 5' $(M_1H)_3$ occludes it while being cooled by a cooler 16 at temperature $T_M$ (point C). Each of the chambers shown in FIG. 3 is connected switchably to heat media held at various temperatures by electromagnetic valves or other suitable means.

Then, $(M_2H)_4$ is heated to temperature $T_M$ by heat source 16 at temperature $T_M$ (point B). On the other hand, $(M_1H)_3$ is heated to the temperature $T_H$ by means of high temperature heat source 13 (point A). Thus, $(M_1H)_3$ releases hydrogen which is sent to a fourth chamber through the porous material 7', and occluded exothermically by $(M_2H)_4$. In the meantime, the temperature of $(M_1H)_1$ is returned to the temperature $T_M$ (point C), and $(M_2H)_2$ endothermically releases hydrogen to take away heat from the cooling load 15 (point D). The released hydrogen is occluded by $(M_1H)_1$. In this manner, one cycle is completed.

Figure 4:
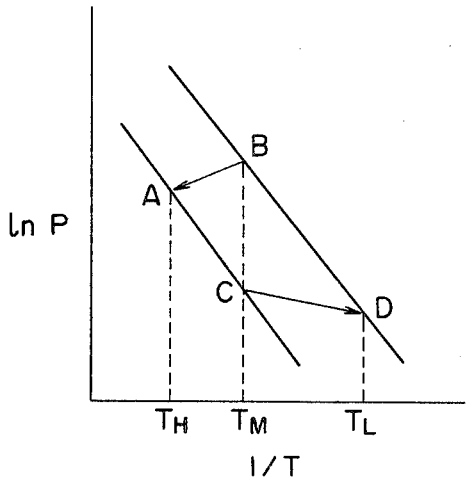
FIG. 4 is a cycle diagram showing the operation of the device of this invention in obtaining a heating output.

In order to obtain a heating output by the heat pump device of FIG. 3, $(M_2H)_2$ is heated to the temperature $T_M$ to release hydrogen (point B) which is caused to be occluded exothermically by $(M_1H)_1$ (point A) to give heat to a heating load 13, as shown in the cycle diagram of FIG. 4. Then, $(M_2H)_2$ is cooled to temperature $T_L$ (e.g., the temperature of the atmospheric air) and the temperature of $(M_1H)_1$ is returned to temperature $T_M$ to cause $(M_1H)_1$ to release hydrogen which is then caused to be occluded by $(M_2H)_2$. $(M_1H)_3$ and $(M_2H)_4$ are subjected to the above operation with a phase difference of a half cycle.

By combining two closed receptacles and operating them with a phase deviation of a half cycle, a cooling output and a heating output can be obtained alternately, and therefore continuously, from the respective receptacles.

Figure 5:
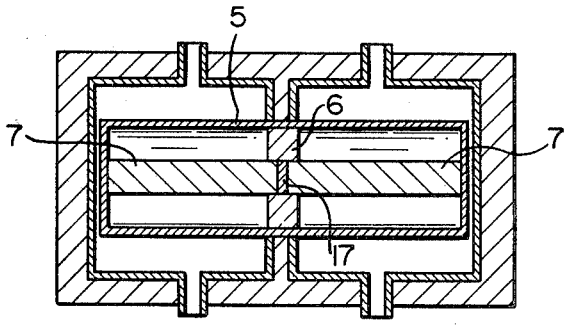
FIG. 5 is a sectional view showing still another embodiment of the device of the invention.

FIG. 5 shows another embodiment of the heat pump device of the invention, in which connections with heat media are omitted. In this embodiment, a porous material 7 which is elastically deformable and permeable both to hydrogen and metal hydrides is used. A shielding material 17 which is permeable to hydrogen but impermeable to metal hydrides, such as a sintered metal body, is disposed in a through-hole of a partitioning wall supporting the porous material 7. The porous material is connected to each side of the shielding member and extends through each chamber. For diffusion of hydrogen, it is beneficial that the porous material extends to the other end of each chamber which faces the shielding member 17.

Figure 7:
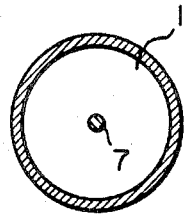
FIG. 7 is a side sectional view of the device of FIG. 6.
Figure 6:
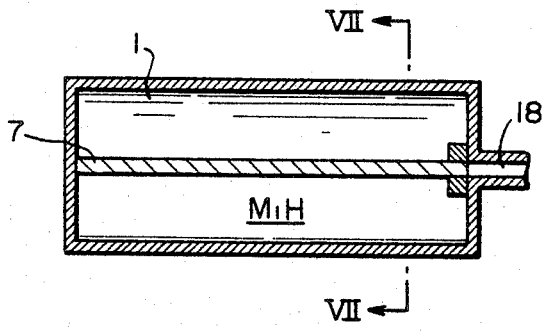
FIG. 6 is a sectional view of yet another embodiment of the device of the invention.

FIGS. 6 and 7 show still another embodiment of the heat pump device of the invention, in which only one of the two closed receptacles is shown, and connections with heat media are omitted. In this embodiment, a first chamber 1 of the closed receptacle communicates with a second chamber (not shown) through a narrow hydrogen passage 18. One end of a porous material 7 being elastically deformable in response to an applied pressure, and being and permeable to hydrogen gas but impermeable to metal hydrides, is connected to the opening of each end of the above hydrogen passage 18. The porous material extends axially of the receptacle and as required is fixed to the inner wall of the receptacle at its other end. The metal hydride $M_1H$ is filled in a space between the inside wall of the receptacle and the porous material. Accordingly, even when the metal hydride expands upon occlusion of hydrogen, the porous material shrinks correspondingly, and any mechanical stress caused by the expansion of the metal hydride is absorbed by the porous material. Consequently, the stress is not exerted on the receptacle or the stress on it is reduced, thereby removing any likelihood of deformation or damage of the receptacle.

Figure 8:
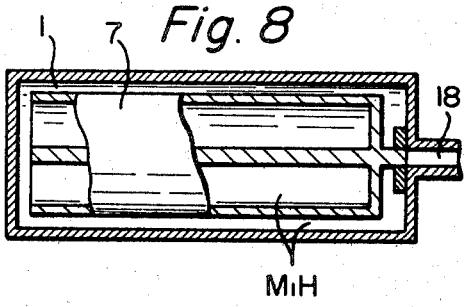
FIG. 8 is a sectional view of still another embodiment of the device of the invention.

FIG. 8 shows another embodiment of the porous material. The porous material connected to the opening of one end of the passage 18 of the receptacle 1 is branched into a multiplicity of porous members each of which extends axially of the receptacle. Because of this construction, hydrogen gas can flow more easily within the receptacle.

Figure 9:
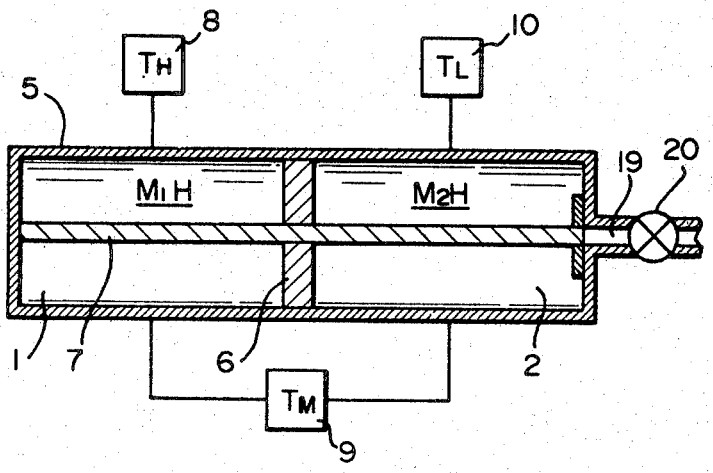
FIG. 9 is a sectional view of a further embodiment of the device of the invention.

The heat pump device shown in FIG. 9 is substantially the same as the device of FIG. 1 except that an opening 19 equipped with a valve 20 is provided at an outside end portion of the chamber 2, and one end of the porous material 7 is connected to the opening 19. Before and after the operation, hydrogen is inserted into, or discharged from, the opening 19.

The operation of obtaining a cooling output by using the heat pump device shown in FIG. 9 is described with reference to the cycle diagram shown in FIG. 2. Let us assume that $M_1H$ is at temperature $T_M$ (point C) and $M_2H$ is at temperature $T_L$ (point D). When $M_1H$ is heated to the temperature $T_H$ by a high temperature heat exchanger 8, a difference in equilibrium dissociation pressure arises between $M_2H$ and $M_1H$ ($M_2H$ is maintained at temperature $T_M$ by an intermediate temperature heat exchanger 9). Hence, $M_1H$ releases hydrogen which is then occluded by $M_2H$. Then, in cooling $M_2H$ to temperature $T_L$ and cooling $M_1H$ to temperature $T_M$, the equilibrium dissociation pressure of $M_2H$ is maintained always lower than that of $M_1H$ until the $M_2H$ attains the temperature $T_L$. This prevents migration of hydrogen from $M_2H$ to $M_1H$ until the $M_2H$ attains a temperature in the vicinity of $T_L$. Then, when $M_2H$ has substantially attained the temperature $T_L$, the equilibrium dissociation pressure of $M_1H$ is made lower than that of $M_2H$ to move hydrogen from $M_2H$ to $M_1H$. By utilizing the absorption of heat incident to the releasing of hydrogen from $M_2H$, $M_2H$ is heat-exchanged with a low temperature heat exchanger 10 as a cooling load. In this way, the absorption of heat by $M_2H$ by hydrogen migration from $M_2H$ to $M_1H$ can be utilized for the cooling of the cooling load without waste. Cooling of $M_2H$ from temperature $T_M$ to temperature $T_L$ may be effected by, for example, a second low temperature heat exchanger (not shown).

A new cycle is started by heating $M_1H$ to temperature $T_H$.

In order to maintain the equilbrium dissociation pressure of $M_2H$ always lower than that of $M_1H$, the following two methods are available. One method comprises cooling $M_1H$ after a lapse of a predetermined period of time from the starting of cooling $M_2H$. For example cooling of $M_1H$ may be started after $M_2H$ has been cooled to a temperature near $T_L$. The other method comprises cooling $M_2H$ and $M_1H$ simultaneously while maintaining the cooling rate of $M_2H$ higher than that of $M_1H$.

The operation of obtaining a heating output by the device shown in FIG. 9 is described below with reference to FIG. 4. Let us assume that $M_1H$ is at temperature $T_H$ (point A), and $M_2H$ is at temperature $T_M$ (point B). When $M_2H$ is cooled to temperature $T_L$ by a low temperature heat exchanger 10, a difference in equilibrium dissociation pressure arises between $M_1H$ and $M_2H$ ($M_1H$ is heated by an intermediate heat exchanger 9). Thus, $M_1H$ releases hydrogen, which is then occluded by $M_2H$. Then, in releasing hydrogen from $M_2H$ and causing it to be exothermically occluded by $M_1H$ to obtain a heating output, the equilibrium dissociation temperature of $M_1H$ is maintained always higher than that of $M_2H$ until the $M_1H$ attains the temperature $T_H$. Thus, hydrogen is prevented from moving from $M_2H$ to $M_1H$ until the $M_1H$ has attained a temperature near temperature $T_H$. Then, when the temperature of $M_1H$ substantially reaches the temperature $T_H$, the equilibrium dissociation temperature of $M_2H$ is made higher than that of $M_1H$ to move hydrogen from $M_2H$ to $M_1H$ and to heat exchange the heat generated incident to hydrogen occlusion of $M_1H$ with high temperature heat exchanger 8 as a heating load. In this way, the heat generated from $M_1H$ incident to hydrogen migration from $M_2H$ to $M_1H$ can be obtained as a heating output without waste. Heating of $M_1H$ from $T_M$ to $T_H$ can be effected by using a second high temperature heat exchanger (not shown).

A new cycle is started by cooling $M_2H$ again to temperature $T_L$.

In order to maintain the equilibrium dissociation pressure of $M_1H$ always higher than that of $M_2H$, it is possible to heat $M_1H$ in advance to temperature $T_H$ and then start the heating of $M_2H$, or to heat them simultaneously while maintaining the heating rate of $M_1H$ higher than that of $M_2H$, as in the case of the cooling device.

Figure 11:
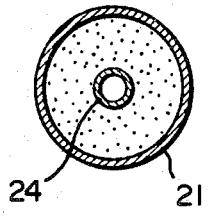
FIG. 11 is a side sectional view of the device of FIG. 10.
Figure 10:
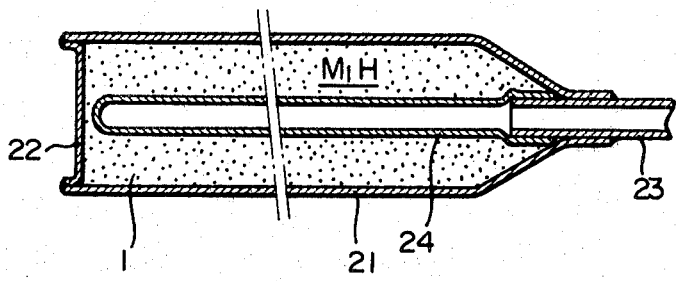
FIG. 10 is a sectional view of an additional embodiment of the device of the invention.

Yet another embodiment of the heat pump device of this invention is shown in FIGS. 10 and 11, in which one of the two chambers is shown and connections to heat media are omitted.

A bottom plate 22 is welded to one end of a copper pipe 21 having an outside diameter of 20 mm, and the other end of the pipe 21 is drawn to an inside diameter of about 6 mm. A copper pipe 23 having an outside diameter of 6 mm is inserted into this drawn portion and fixed by welding. One end of a tube 24 (outside diameter 6 mm) made of a sintered body of polytetrafluoroethylene is fitted in the end portion of the copper pipe 23, and its other end is sealed up. The tube 24 has a plurality of holes (about 2 microns in diameter) extending through its wall. These holes are permeable to hydrogen but impermeable to metal hydrides. Metal hydride $M_1H$ is filled in the space between the copper pipe 21 and the porous tube 24. The copper pipe 21 has a thickness of 1 mm and a substantial length of about 500 mm. Thus, a first chamber 1 is formed. On the other hand, at the other end of the pipe 23, a second chamber (not shown) having the same structure as the chamber 1 is formed and a second metal hydride $M_2H$ is filled therein.

Figure 12:
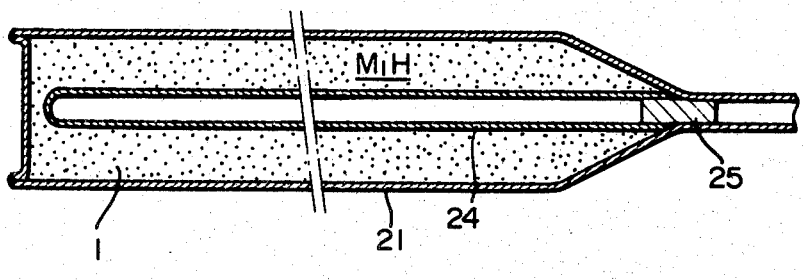
FIG. 12 is a sectional view of still another embodiment of the device of the invention.

In the embodiment shown in FIG. 12, the slender copper pipe 23 is omitted, and instead, the drawn portion of the thick pipe 21 is elongated to form a communicating passage between the two chambers, and the porous tube 24 is fixed between the drawn portion of the pipe 21 and the porous sintered metal 25. Otherwise, the device of FIG. 12 is the same as the device of FIG. 10. The porous tube 24 may be a stretched porous body of polytetrafluoroethylene.

Figure 13:
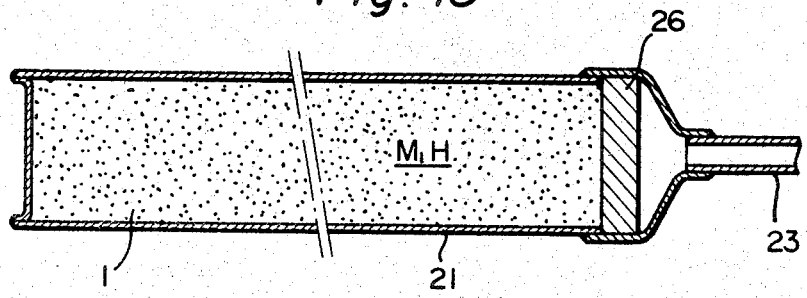
FIG. 13 is a sectional view of one example of a heat pump device outside the scope of the invention.

FIG. 13 shows one example of a heat pump device outside the scope of the invention, illustrating the cross section of the receptacle used in the Comparative Example described hereinbelow. It is of the same structure as the device of FIG. 10 except that a porous sintered stainless steel filter (pore diameter about 2 microns) is provided near the drawn portion of the copper pipe 21 instead of the polytetrafluoroethylene sintered tube 24.

EXAMPLE 1

In the receptacle shown in FIGS. 6 and 7, the chamber 1 was made of a copper pipe having an outside diameter of 3.5 cm and a thickness of 1 mm and its internal volume was adjusted to 0.5 liter. As the porous material 7, a cylindrical sintered polytetrafluoroethylene structure having an outside diameter of 5 mm was used. $LaNi_5$ alloy was filled in the chamber 1, and hydrogen was sufficiently caused to be occluded therein. Scarcely any stress was generated on the surface of the receptacle.

On the other hand, when $LaNi_5$ alloy was filled in the same receptacle as above except that the porous material 7 was omitted and hydrogen was caused to be occluded fully, stress was generated on the surface of the receptacle in an amount of 0.02.

EXAMPLE 2

450 g of $LaNi_{4.7}Al_{0.3}$ as $M_1H$ and 450 g of $LaNi_5$ as $M_2H$ were filled respectively in the first and second chambers of a receptacle of the type shown in FIGS. 10 and 11. Ten such receptacles were set in one jacket. Thus, the total amount of the metal alloy in each of $M_1H$ and $M_2H$ was 4.5 kg.

The weight of each chamber was 300 g, and therefore, the total weight of the chambers was 3 kg both on the $M_1H$ side and the $M_2H$ side.

$T_H$ was adjusted to 90° C., and $T_M$, to 30° C., and the operation of obtaining heating output was carried out in accordance with the procedure described hereinabove with reference to FIGS. 1 and 2. Cold water at $T_L$ 10° C. was obtained.

The amount of heat supplied ($Q_S$) and the amount of heat obtained ($Q_G$) were determined as follows:

$$Q_S = Q_1 + Q_2$$

wherein $Q_1$=(the heat of reaction of $M_1H$ per mole of hydrogen; $a_1$)×(the amount in moles of hydrogen which migrated in each of the receptacles; $m_1$)×(number of the receptacles), $Q_2$=(the weight of $M_1H$+the weight of the receptacles)×(specific heat h)×($T_H$-$T_L$)

$$Q_G = Q'_1 - Q'_2$$

wherein $Q'_1$=(the heat of reaction of $M_2H$ per mole of hydrogen; $a_2$)×(the amount in moles of hydrogen which migrated in each of the receptacles; $m_2$)×(number of the receptacles)

$Q'_2$=(the weight of $M_2H$+the weight of the receptacles)×(specific heat h)×($T_M$-$T_L$)

In the present Example, $a_1$=7.8 kcal, $a_2$=7.2 kcal, h=0.1, $m_1$=2.2 moles and $m_2$=1.6 moles.

Accordingly, $$Q_S = (7.8 \times 2.2 \times 10) + (4.5 + 3) \times 0.1 \times (90 - 30) = 171.6 + 4.5 = 216.6 \text{ kcal}$$
$$Q_G = (7.2 \times 1.6 \times 10) - (4.5 + 3) \times 0.1 \times (30 - 10) = 115.2 - 15 = 100.2 \text{ Kcal}$$

Hence, the coefficient of performance was as follows:

$$COP = \frac{Q_G}{Q_S} \approx 0.46$$

The time required for hydrogen to move from $M_1H$ to $M_2H$ was about 30 minutes.

EXAMPLE 3

The same receptacles as used in Example 2 were used, and the types and amounts of alloys were the same as in Example 2.

The operation of obtaining a cooling output was performed in accordance with the procedure described hereinabove with reference to FIGS. 2 and 9. $T_H$ was adjusted to 90° C., and $T_M$, to 30° C., and cold water at $T_L$ 10° C. was obtained.

$A_1$=7.8 kcal, $a_2$=7.2 kcal, $m_1$=2 moles, $m_2$=2 moles

Accordingly, $$Q_S = (7.8 \times 2 \times 10) + (4.5 + 3) \times 0.1 \times (90 - 30) = 156 + 45 = 201 \text{ kcal}$$
$$Q_G = (7.2 \times 2 \times 10) - (4.5 + 3) \times 0.1 \times (30 - 10) = 144 - 15 = 129 \text{ kcal}$$

Hence, $$COP = \frac{Q_G}{Q_S} \approx 0.65$$

The time required for migration of hydrogen from $M_1H$ to $M_2H$ was about 30 minutes.

COMPARATIVE EXAMPLE

Example 2 was repeated except that the receptacle shown in FIG. 13 was used instead of the receptacle shown in FIGS. 10 and 11.

When the time required for hydrogen migration from $M_1H$ to $M_2H$ was adjusted to 30 minutes, 14 kcal of cold water at $T_L$ 10° C. was obtained by using 90 kcal of a heat source at $T_H$ 90° C. and maintaining $T_M$ at 30° C.

Accordingly, $$COP = \frac{14}{90} \approx 0.16$$

According to the device of the invention described hereinabove, the volume expansion of the metal hydride upon occlusion of hydrogen is absorbed by the elastically deformable porous material. Hence, the receptacle as a heat exchanger scarcely undergoes mechanical stress incident to the volume expansion of the metal hydride, and is not deformed nor damaged. Furthermore, in designing the receptacle, the equilibrium dissociation pressure of the metal hydride is the only factor that needs to be specially considered. Consequently, the weight of the receptacle per unit amount of the metal hydride can be small, and the coefficient of performance of the device increases. Furthermore, since the porous material concurrently serves as a flow passage for hydrogen, diffusion of hydrogen is improved, and the occlusion and releasing of hydrogen by metal hydrides can be performed smoothly and rapidly.

Furthermore, according to a preferred embodiment of the invention, the movement of hydrogen between the metal hydrides is hampered in a step prior to obtaining an output, and is permitted only in a stage of obtaining the output. Hence, the absorption or generation of heat during the reaction of metal hydrides incident to hydrogen migration can be obtained as an output without waste. As a result, when the device of this invention is used as an air-conditioning device, its cooling and heating ability can further be improved.

What we claim is:

1. A heat pump device comprising a closed receptacle divided into a first chamber and a second chamber, means forming a hydrogen flow passage extending through the two chambers, said hydrogen flow passage permitting the flow of hydrogen, but rejecting the flow of metal hydrides, between the two chambers and being made at least partly of a porous material permeable to hydrogen and elastically deformable in response to an applied pressure, a first metal hydride filled in the first chamber and a second metal hydride filled in the second chamber, and means for externally heating and cooling the first chamber and the second chamber separately whereby the first chamber can be maintained at high temperature $T_H$ or intermediate temperature $T_M$ and the second chamber can be maintained at intermediate temperature $T_M$ or low temperature $T_L$, said heat pump device being adapted to perform a heat transfer process comprising heating the first metal hydride to release hydrogen therefrom, conducting the released hydrogen to said hydrogen flow passage, allowing the second metal hydride to occlude the released hydrogen exothermically, then cooling the first metal hydride, allowing the second metal hydride to release hydrogen endothermically, conducting the released hydrogen to said hydrogen flow passage and allowing the first metal hydride to occlude the released hydrogen exothermically.

2. The heat pump device of claim 1 wherein the two chambers are connected to each other by communicating passage, and said means forming said hydrogen flow passage is composed of said communicating passage and porous materials each having one end connected to each end of said communicating passage and the other end extending into each of the two chambers, said porous materials being elastically deformable and permeable to hydrogen but impermeable to metal hydrides.

3. The heat pump device of claim 1 wherein said porous material is a rod-like porous material permeable to hydrogen but impermeable to metal hydrides.

4. The heat pump device of claim 1 wherein said porous material is a hollow cylindrical structure permeable to hydrogen but impermeable to metal hydrides.

5. A heat pump device comprising a closed receptacle divided into a first chamber and a second chamber, means forming a hydrogen flow passage extending through the two chambers, said hydrogen flow passage permitting the flow of hydrogen, but rejecting the flow of metal hydrides, between the two chambers and being made at least partly of a porous material permeable to hydrogen and elastically deformable in response to an applied pressure, a first metal hydride filled in the first chamber and a second metal hydride filled in the second chamber, said heat pump device being adapted to perform a heat transfer process comprising allowing the second metal hydride to release hydrogen endothermically at a low temperature $T_L$ and the first metal hydride to occlude the released hydrogen to thereby obtain a cooling output, or allowing the second metal hydride to release hydrogen and the first metal hydride to occlude the released hydrogen exothermically at a high temperature $T_H$ to thereby obtain a heating output; wherein until said second metal hydride is cooled to the temperature $T_L$, the equilibrium dissociation pressure of the second metal hydride is maintained lower than that of the first metal hydride, and when the second metal hydride has substantially attained the temperature $T_L$, the equilibrium dissociation pressure of the first metal hydride is made lower than that of the second metal hydride to release hydrogen endothermically from the second metal hydride, or wherein until the first metal hydride is heated to the temperature $T_H$, the equilibrium dissociation pressure of the first metal hydride is maintained higher than that of the second metal hydride, and when the first metal hydride has substantially attained the temperature $T_H$, the equilibrium dissociation pressure of the second metal hydride is made higher than that of the first metal hydride to allow the first metal hydride to occlude hydrogen exothermically.

6. The heat pump device of claim 5 wherein the two chambers are connected to each other by a communicating passage and said means forming said hydrogen flow passage is composed of said communicating passage and porous materials each having one end connected to each end of said communicating passage and the other end extending into each of the two chambers, said porous materials being elastically deformable and permeable to hydrogen but impermeable to metal hydrides.

7. The heat pump device of claim 5 wherein said porous material is a rod-like porous material permeable to hydrogen but impermeable to metal hydrides.

8. The heat pump device of claim 5 wherein said porous material is a hollow cylindrical structure permeable to hydrogen but impermeable to metal hydrides.

* * * * *